US009120618B2

(12) United States Patent
Peterson

(10) Patent No.: US 9,120,618 B2
(45) Date of Patent: Sep. 1, 2015

(54) CORNER BLOCK ADJUSTMENT MECHANISM FOR AN ISO CONTAINER

(75) Inventor: Mark A. Peterson, Cadillac, MI (US)

(73) Assignee: AAR Corp., Wood Dale, IL (US)

( * ) Notice: Subject to any disclaimer, the term of this patent is extended or adjusted under 35 U.S.C. 154(b) by 678 days.

(21) Appl. No.: 13/479,422

(22) Filed: May 24, 2012

(65) Prior Publication Data

US 2013/0313269 A1 Nov. 28, 2013

(51) Int. Cl.
*B65D 90/00* (2006.01)

(52) U.S. Cl.
CPC ..... *B65D 90/0026* (2013.01)

(58) Field of Classification Search
CPC ..... B65D 88/00; B65D 88/12; B65D 88/14; B65D 88/005; B65D 88/022; B65D 88/121; B65D 90/0026; B65D 90/00; B65D 90/0006; B60P 7/13; B60P 7/132
USPC ..... 403/314, 350, 367, 374.1, 321, 322.1, 403/322.3, 322.5; 220/1.5; 410/77, 78, 81, 410/82, 23
See application file for complete search history.

(56) References Cited

U.S. PATENT DOCUMENTS

| | | | | | |
|---|---|---|---|---|---|
| 2,937,879 | A | | 5/1960 | Lion | |
| 3,331,333 | A | * | 7/1967 | Coulson | 410/81 |
| 3,386,696 | A | * | 6/1968 | Duval et al. | 24/287 |
| 3,556,458 | A | * | 1/1971 | Erith et al. | 410/83 |
| 3,734,442 | A | * | 5/1973 | Lunde | 410/77 |
| 3,752,511 | A | * | 8/1973 | Racy | 24/287 |
| 3,966,075 | A | | 6/1976 | Schultz | |
| 4,026,596 | A | * | 5/1977 | Carr | 410/82 |
| 4,266,820 | A | * | 5/1981 | Whaley et al. | 296/35.3 |
| 4,428,491 | A | | 1/1984 | Mittelmann et al. | |
| 4,569,219 | A | | 2/1986 | Threlkel et al. | |
| 4,805,794 | A | | 2/1989 | Tsuchiya et al. | |
| 4,911,318 | A | | 3/1990 | Bishop | |
| 4,995,522 | A | | 2/1991 | Barr | |
| 5,163,726 | A | * | 11/1992 | Boos et al. | 294/81.1 |
| 5,237,784 | A | | 8/1993 | Ros | |
| 5,284,266 | A | | 2/1994 | Januel et al. | |
| 5,423,518 | A | | 6/1995 | Baxter et al. | |
| 5,507,660 | A | | 4/1996 | Jalliffier | |
| 5,761,854 | A | | 6/1998 | Johnson et al. | |
| 5,878,903 | A | | 3/1999 | Ung | |
| 6,223,479 | B1 | | 5/2001 | Stockli | |

(Continued)

FOREIGN PATENT DOCUMENTS

| | | |
|---|---|---|
| DE | 4214267 | 11/1993 |
| DE | 4433061 | 3/1996 |

(Continued)

OTHER PUBLICATIONS

International Search Report in PCT Application PCT/US2013/037994, dated Sep. 27, 2013.

(Continued)

*Primary Examiner* — Daniel Wiley
(74) *Attorney, Agent, or Firm* — Barnes & Thornburg LLP

(57) ABSTRACT

A corner block adjustment mechanism for an ISO container. The adjustment mechanism includes a selectively rotatable cam for moving a corner block between an extended position and a retracted position. The adjustment mechanism also includes a locking mechanism for selectively locking the corner block in the extended position and the retracted position.

18 Claims, 8 Drawing Sheets

(56) References Cited

U.S. PATENT DOCUMENTS

| | | | |
|---|---|---|---|
| 6,227,397 | B1 | 5/2001 | Kim |
| 6,622,640 | B2 | 9/2003 | Taylor et al. |
| 6,655,300 | B1 | 12/2003 | Clive-Smith et al. |
| 6,729,098 | B1 | 5/2004 | Brennan, Jr. |
| 7,036,786 | B1 | 5/2006 | Schura |
| 7,059,488 | B2 | 6/2006 | Myers |
| 7,717,290 | B2 | 5/2010 | Gerding |
| 7,724,112 | B2 | 5/2010 | Kerr |
| 8,074,818 | B2 | 12/2011 | Gerding |
| 2005/0160682 | A1 | 7/2005 | Quadrio |

FOREIGN PATENT DOCUMENTS

| | | |
|---|---|---|
| GB | 1451388 | 9/1976 |
| GB | 2476299 | 6/2011 |
| JP | 687292 | 12/1994 |

OTHER PUBLICATIONS

Written Opinion in PCT Application PCT/US2013/037994, dated Sep. 27, 2013.

International Preliminary Report on Patentability and Written Opinion in PCT Application PCT/US2013/037994, dated Nov. 25, 2014.

* cited by examiner

CORNER BLOCK ADJUSTMENT MECHANISM FOR AN ISO CONTAINER

BACKGROUND

The present disclosure is directed to a corner block adjustment mechanism for use with a container, such as a standard International Organization for Standardization (ISO) container, such that the container is adapted to directly interface with internal aircraft cargo handling systems and also with ISO container handling systems used in truck, train and ship cargo transportation.

ISO containers have four top ISO corner blocks located respectively at each of the four top corners of the container, and four bottom ISO corner blocks located respectively at each of the four bottom corners of the container. ISO containers have to conform to specific ISO transportation requirements for truck, train and ship modes of transportation. In land or sea transportation the ISO corner blocks are adapted to lock the container into position and hold it securely. The four bottom ISO corner blocks are required to maintain an average distance of approximately one-half inch (12.5 millimeters) below any other part of the container base, such as the bottom surface of the container base.

On the other hand, internal aircraft cargo handling systems rely upon the container being shipped having a flat bottom, without any downwardly extending projections, adapted to roll on the internal roller conveyor system of the cargo handling system. The projection of the bottom corner blocks below the bottom surface of the ISO container is in direct opposition to the requirements of an aircraft cargo handling system and causes interference with the aircraft cargo handling system. The present disclosure enables an ISO container to conform to ISO transportation requirements for shipment by truck, train and ship modes of transportation and also to conform to the requirements of an internal aircraft cargo handling system of an aircraft for shipment by air.

DETAILED DESCRIPTION

Figure 2:
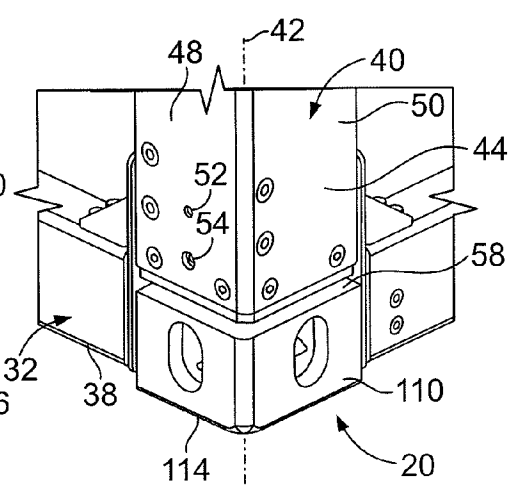
FIG. 2 is an enlarged view taken along line 2 of FIG. 1 showing the corner block adjustment mechanism coupled to the container and the lower corner block in the extended position.
Figure 3:
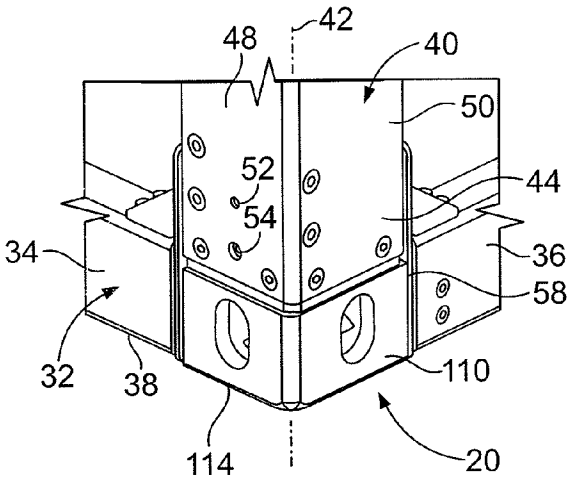
FIG. 3 is a view similar to the view of FIG. 2 but with the corner block of the adjustment mechanism shown in the retracted position.
Figure 1:
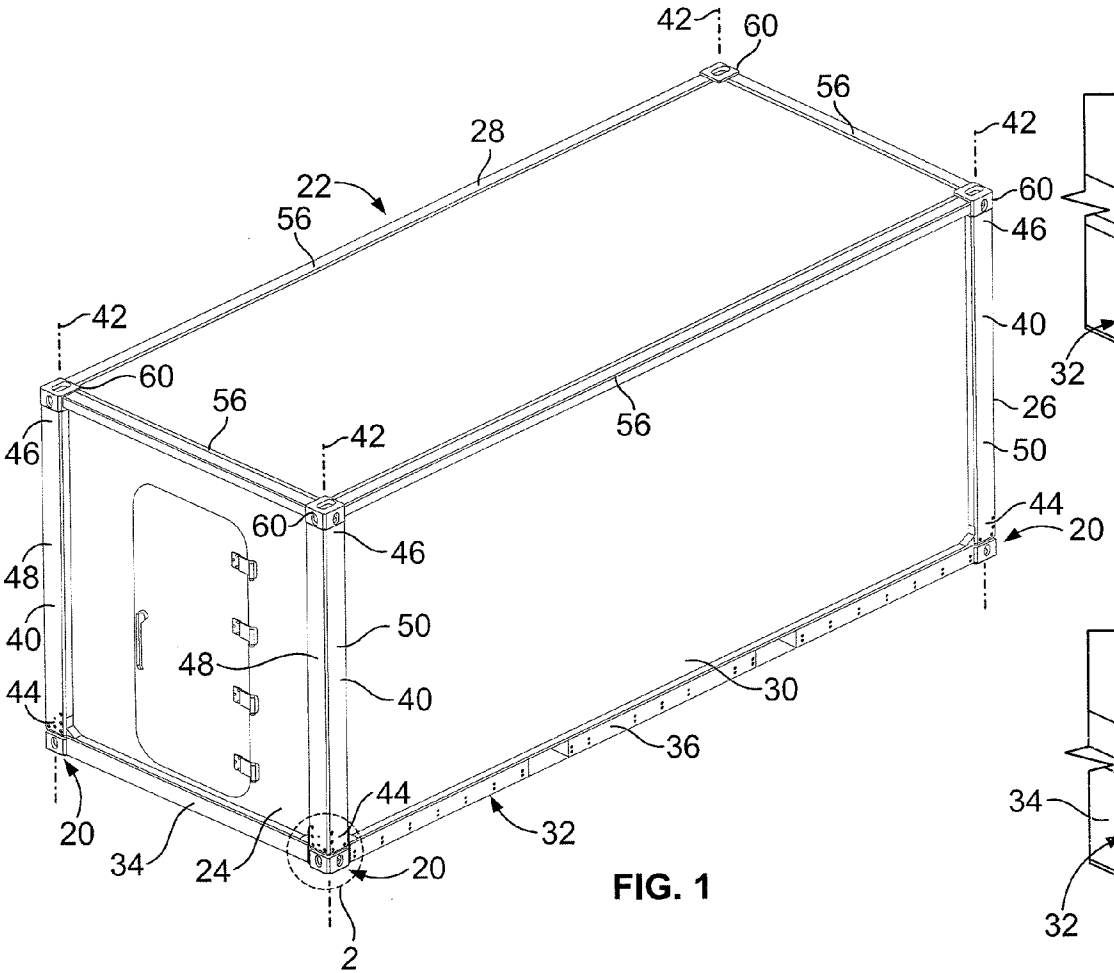
FIG. 1 is a perspective view of an ISO container shown with fixed top ISO corner blocks and with corner block adjustment mechanisms for movement of the lower ISO corner blocks between an extended ISO position and a retracted position.

A plurality of corner block adjustment mechanisms 20 are shown in FIG. 1 coupled to an ISO container 22. ISO container 22 is internally air transportable within an aircraft and is also transportable by truck, train and ship in accordance with ISO requirements. The container 22 extends between a first longitudinal end 24 and a second longitudinal end 26, and between a first transverse end 28 and a second transverse end 30. Container 22 includes a base 32. Base 32 includes a first end rail 34 at the first longitudinal end 24 and a spaced apart and generally parallel end rail, not shown, located at the second longitudinal end 26. Base 32 also includes a first side rail, not shown, at the first transverse end 28 and a second side rail 36 at the second transverse end 30. Each side rail is elongate and generally linear. Base 32 includes a generally planar bottom surface 38. Bottom surface 38 may be formed by one or more plate members adapted to engage rollers of an aircraft cargo handling system.

Container 22 includes a plurality of corner posts 40, one corner post 40 being located at each of the four corners of the container 22. Each corner post 40 includes a vertical generally linear axis 42 and extends between a bottom end 44 and a top end 46. Each corner post 40 is generally linear and elongate and may comprise a generally rectangular tube or a generally L-shaped member. Corner post 40 includes a generally planar first wall 48 and generally planar second wall 50 that is disposed at generally a right angle to first wall 48. First wall 48 is located at a longitudinal end of container 22 and second wall 50 is located at a transverse end of container 22. First wall 48 includes a first aperture 52 and a second aperture 54 that are spaced apart from one another along the axis 42 and that are located at bottom end 44 of corner post 40.

Container 22 includes a plurality of upper rails 56 with each upper rail 56 extending between top ends 46 of adjacent corner posts 40. One or more side panels extend between adjacent corner posts 40 and between upper rails 56 and lower rails 32 and 34. The side panels may include doors, windows and other types of openings and tie down members. Each lower corner of container 22 includes a pocket 58 formed between an end of a side rail and the end of an end rail and that is located below the bottom end 44 of a corner post 40. An upper ISO corner block 60 is coupled to top end 46 of each corner post 40 and two upper rails 56. Upper corner block 60 conforms to ISO standards and includes a plurality of side apertures and a top aperture. Upper corner blocks 60 are stationary with respect to corner post 40.

A corner block adjustment mechanism 20 is coupled to bottom end 44 of each corner post 40. Corner block adjustment mechanism 20 includes a base 70 having a central axis 72 that extends between a distal or bottom end 74 and a proximal or top end 76 of base 70. The base 70 includes a first end wall 78 and a spaced apart and generally parallel second end wall 80. Base 70 also includes a first side wall 82 and a spaced apart and generally parallel second side wall 84. Sidewalls 82 and 84 extend between end walls 78 and 80 such that base 70 is generally rectangular. First end wall 78 of base 70 is adapted to be coupled to the first wall 48 at the bottom end 44 of a corner post 40 and second side wall 84 is adapted to be coupled to second wall 50 at bottom end 44 of the corner post 40 by one or more fasteners, such that central axis 72 is generally parallel to axis 42 of corner post 40.

Base 70 includes an internal hollow chamber 86, and an opening 88 at bottom end 74 that is in communication with chamber 86, and an opening 90 at top end 76 that is in communication with chamber 86. A flange extends outwardly from bottom end 74 of base 70 that is adapted to engage bottom end 44 of corner post 40. First and second end walls 78 and 80 each include a first aperture 92 that are coaxially aligned with one another along a first axis 94, a second aperture 96 that are coaxially aligned with one another along a second axis 98, and a third aperture 100 that are coaxially aligned with one another along a third axis 102. First axis 94, second axis 98 and third axis 102 are generally parallel to one another and are spaced apart from one another along axis 72. Second axis 98 is located between first axis 94 and third axis 102. A cover 104 is adapted to be removably coupled to top end 76 of base 70 by one or more fasteners. Second aperture 96 of first end wall 78 is adapted to be aligned with first aperture 52 of first wall 48 of corner post 40. Third aperture 100 of first end wall 78 is adapted to be aligned with second aperture 54 of first wall 48 of corner post 40.

Corner block adjustment mechanism 20 includes a movable lower ISO corner block 110 that conforms to ISO requirements. Lower corner block 110 includes a generally planar bottom wall 112 having a generally planar bottom surface 114 and an aperture 116 formed in bottom wall 112. Lower corner block 110 also includes a top wall 118 spaced apart from and generally parallel to bottom wall 112. Bottom wall 112 and top wall 118 are generally perpendicular to axis 72. Lower corner block 110 also includes a plurality of side walls 120 that extend between bottom wall 112 and top wall 118 that are arranged in a generally rectangular manner. At least two side walls 120 include an aperture 122.

Corner block adjustment mechanism 20 also includes a stem 130 attached to top wall 118 of lower corner block 110. Stem 130 includes a distal or bottom end 132 and a proximal or top end 134. Stem 130 also includes a generally planar first end wall 136 and a generally planar second end wall 138 spaced apart from and generally parallel to first end wall 136. Stem 130 also includes a generally planar first side wall 140 and a generally planar second side wall 142 spaced apart from and generally parallel to first side wall 140. First and second side walls 140 and 142 extend between first end wall 136 and second end wall 138 and form a generally rectangular tube therewith. Stem 130 extends between bottom end 132 and top end 134 generally concentrically about central axis 72. If desired, stem 132 may include one or more internal walls 144 that extend between first side wall 140 and second side wall 142 and that are generally equally spaced apart from one another and with first end wall 136 and second end wall 138. First end wall 136, second end wall 138 and each internal wall 144 include a first aperture 146, such as a vertically elongated slot. The apertures 146 are coaxially aligned with one another along a generally linear axis 148. First end wall 136, second end wall 138 and each internal wall 144 include a second aperture 150, such as a horizontally elongated slot. The second apertures 150 are coaxially aligned with one another along a generally linear axis 152. Axis 148 and axis 152 are generally parallel to one another and are spaced apart from one another along axis 72 and are generally perpendicular to axis 72.

Stem 130 is adapted to extend through opening 88 in bottom end 74 of base 70 and into chamber 86. First end wall 136 of stem 130 is adapted to be located generally parallel to and adjacent first end wall 78 of base 70, and second end wall 138 of stem 130 is adapted to be located generally parallel to and adjacent second end wall 80 of base 70. First apertures 146 of stem 130 are adapted to be aligned with second apertures 96 of base 70. Second apertures 150 of stem 130 are adapted to be aligned with third apertures 100 of base 70. Stem 130 and lower corner block 110 are selectively slidable with respect to base 70 generally linearly along central axis 72 between a retracted position and an extended position.

Corner block adjustment mechanism 20 includes a cam 160 having a generally cylindrical first hub 162 and a spaced apart generally cylindrical second hub 164. First hub 162 and second hub 164 are generally concentrically located along a generally linear central axis 166. Cam 160 includes a camming member 170 having a generally cylindrical camming surface 172. Camming member 170 is located between and is attached at each end to first hub 162 and second hub 164. Camming member 170 extends along a generally linear central axis 174 that is generally parallel to and spaced apart from axis 166. Camming surface 172 includes a first surface portion located a first distance from axis 166 and a second surface portion located a second distance from axis 166, the first distance being longer than the second distance. Axis 166 is generally perpendicular to axis 72 of base 70. Axis 174 of camming member 170 is offset from axis 166 of first and second hubs 162 and 164 by approximately one-quarter inch, although other offset distances may be used as desired. A socket 176 is located in the face 178 of first hub 162 generally conctrically with axis 166. Socket 176 is adapted to receive a tool such as the drive shaft of a socket wrench.

First hub 162 of cam 160 is located within third aperture 100 of first end wall 78 of base 70 and is rotationally coupled to first end wall 78 of base 70. Second hub 164 of cam 160 is located within third aperture 100 of second end wall 80 of base 70 and is rotationally coupled to second end wall 80 of base 70. An O-ring 180 creates a seal between first hub 162 and first end wall 78 and an O-ring 180 creates a seal between second hub 164 and second end wall 80 of base 70. Camming member 170 extends through second apertures 150 in first end wall 136, second end wall 138 and internal walls 144 of stem 130. The diameter of camming member 170 and of camming surface 172 is approximately equal to or slightly smaller than the vertical distance between the bottom edge of second aperture 150 and the top edge of second aperture 150. Axis 166 of cam 160 is generally parallel to and generally coaxial with third axis 102 of third apertures 100 of base 70. Cam 160 is selectively rotatable about axis 102 and axis 166 with respect to base 70 and stem 130 between a retracted position and an extended position.

Corner block adjustment mechanism 20 also includes a locking mechanism 190. Locking mechanism 190 includes an elongate and generally linear guide member such as a guide pin 192 having a first end 194 and a second end 196. Guide pin 192 may be generally cylindrical. First end 194 of guide pin 192 is located within first aperture 92 of first end wall 78 of base 70 and second end 196 of guide pin 192 is located within aperture 92 of second end wall 80 of base 70. Guide pin 192 extends generally concentrically along first axis 94. First end 194 and second end 196 of guide pin 192 may include generally annular recesses for the receipt of retaining rings 198.

Locking mechanism 190 also includes an elongate and generally linear release member such as a release pin 200. Release pin 200 may be generally cylindrical and extends generally concentrically along second axis 98 between a first end 202 and a second end 204. First end 202 of release pin 200 is located within second aperture 96 of first end wall 78 of base 70 and second end 204 of release pin 200 is located within second aperture 96 of second end wall 80 of base 70. A bearing sleeve 206 is located within second aperture 96 of first end wall 78 and within second aperture 96 of second end wall 80. Bearing sleeves 206 are adapted to slidably receive release pin 200 such that release pin 200 is selectively slidable along second axis 98 between a locked position and an unlocked position. Release pin 200 extends through first apertures 146 in first end wall 136, second end wall 138 and internal walls 144 of stem 130. Release pin 200 is selectively slidable along second axis 98 with respect to base 70 and stem 130 between its locked and unlocked positions.

Cam 160 includes a first locking lug such as a pin 208 and a second locking lug such as a pin 210. First locking pin 208 and second locking pin 210 each include a proximal end located within an aperture of camming member 170. First locking pin 208 and second locking pin 210 are located on opposite sides of camming member 170 such that locking pin 208 extends along a generally linear central axis 212 from its proximal end to a distal end 214. Second locking pin 210 also extends along axis 212 from its proximal end to a distal end 216. Axis 212 of locking pins 208 and 210 is generally perpendicular to axis 166 and third axis 102 and intersects therewith. Central axis 212 is generally perpendicular to a plane that includes axis 166 and axis 174 of cam 160. A roller such as a bushing 218 is rotationally coupled to distal end 214 of first locking pin 208 and a roller such as a bushing 218 is rotationally coupled to distal end 216 of second locking pin 210 for rotation about axis 212. A retaining ring may removably couple each bushing 218 to the first and second locking pins 208 and 210.

Locking mechanism 190 includes a locking member 220 that is generally plate-like. Locking member 220 includes an aperture 222 at an upper end of locking member 220. Aperture 222 is adapted to slidably receive guide pin 192 such that locking member 220 is selectively slidable along guide pin 192 and axis 94 with respect to base 70 and stem 130 between a locked position and an unlocked position. Locking member 220 also includes an aperture 224 adapted to receive release pin 200. Locking member 220 and release pin 200 are coupled to one another for conjoint movement by fasteners such as retaining rings 226 that are located on opposite sides of locking member 220 and within annular grooves in release pin 200. Release pin 200 and locking member 220 are thereby conjointly slidable with one another along second axis 98 between locked and unlocked positions. A stop member 228 such as a retaining ring is coupled to release pin 200 and within chamber 86 of base 70 to selectively engage an interior surface of first end wall 78 of base 70 to prevent further sliding movement of locking member 220 toward first end wall 78 beyond a predetermined position.

Locking member 220 includes a generally U-shaped fork 230 at its bottom end. Fork 230 includes a first locking arm 232 having a distal end 234 and a spaced apart second locking arm 236 having a distal end 238. First locking arm 232 and second locking arm 236 are spaced apart from one another such that camming member 170 is located therebetween. Fork 230 includes a generally planar engagement surface 240 that is generally perpendicular to third axis 102 and that extends generally in an arc of a circle from distal end 234 of first locking arm 232 to distal end 238 of second locking arm 236. A resilient first biasing member 244, such as a helical coil spring, extends around guide pin 192 and extends between locking member 220 and an interior surface of first end wall 78 of base 70. A resilient second biasing member 246, such as a helical coil spring, extends around guide pin 192 and extends between locking member 220 and an internal surface of second end wall 80 of base 70. Biasing members 244 and 246 resiliently bias locking member 220 toward its locked position, while allowing locking member 220 to be slid along third axis 102 toward its unlocked position.

Figure 4:
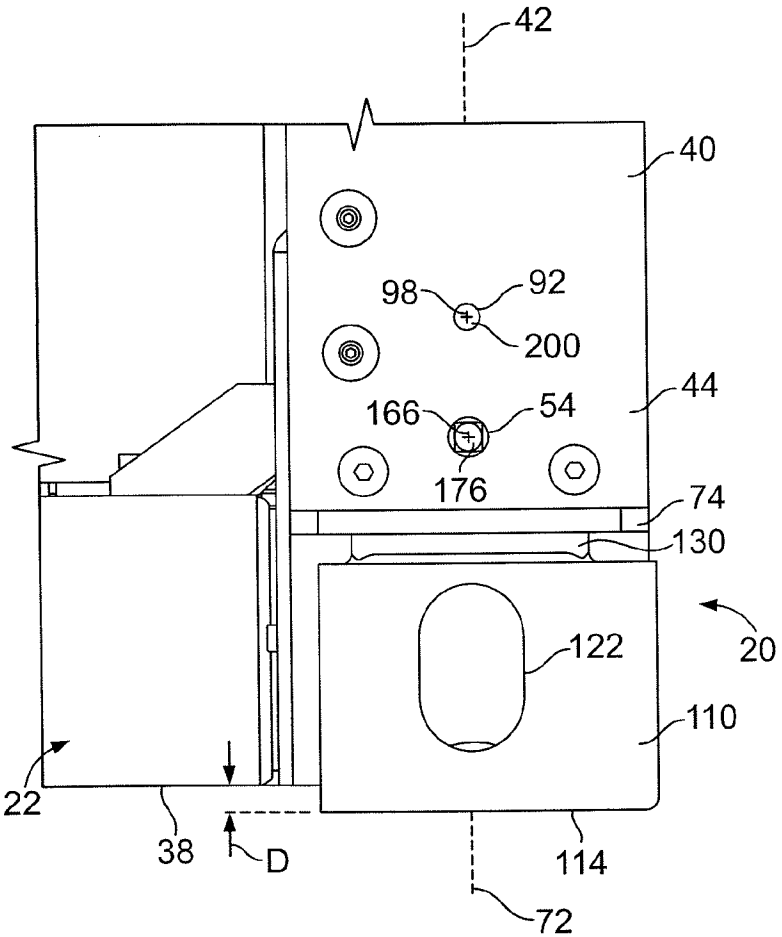
FIG. 4 is a side elevational view of the corner block adjustment mechanism coupled to a lower corner of a container with the lower corner block in the extended position.
Figure 7:
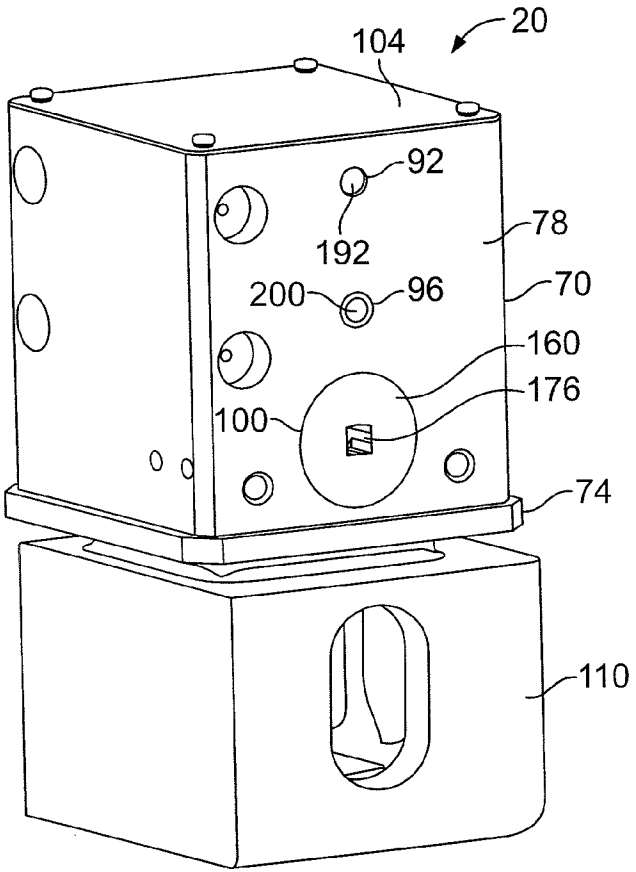
FIG. 7 is a perspective view of the corner block adjustment mechanism of the corner block in the extended position.
Figure 6:
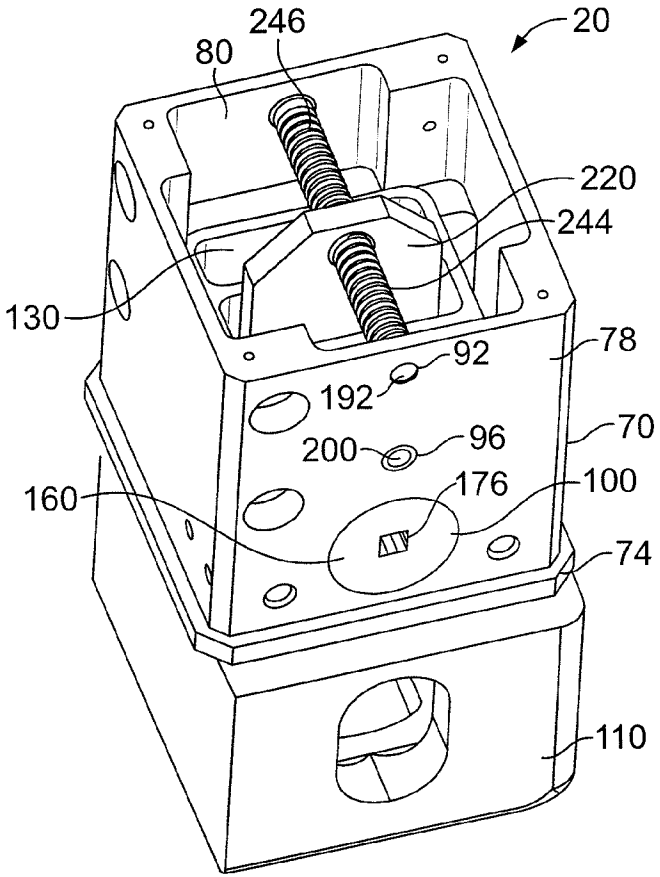
FIG. 6 is a perspective view of the corner block adjustment mechanism shown with the corner block in the extended position and with the cover removed.
Figure 10:
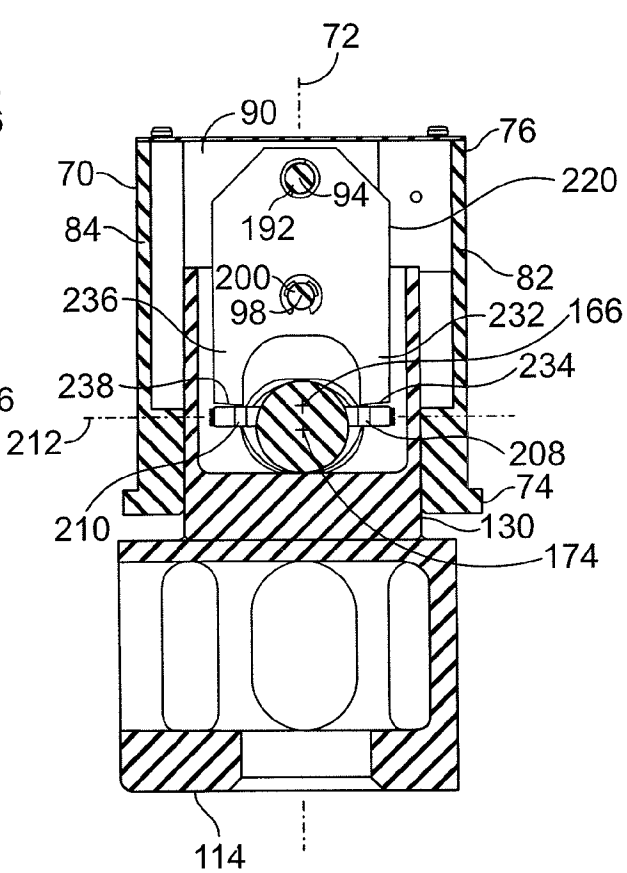
FIG. 10 is a cross sectional view taken along line 10-10 of FIG. 9.
Figure 9:
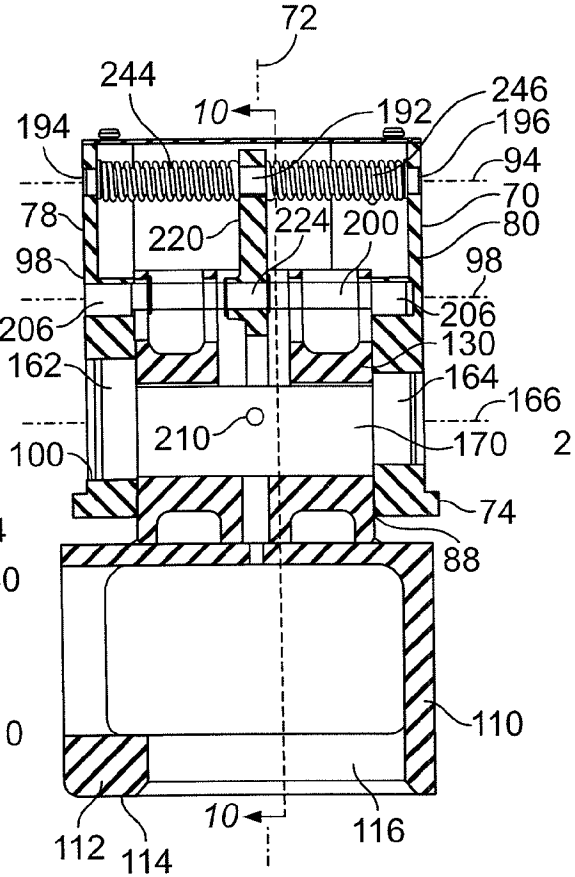
FIG. 9 is a cross sectional view taken along line 9-9 of FIG. 8.
Figure 8:
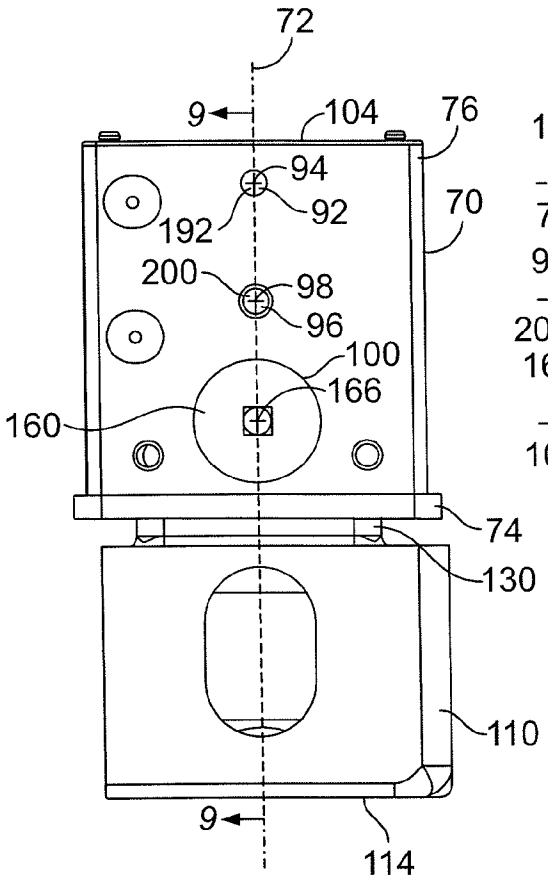
FIG. 8 is a side elevational view of the corner block adjustment mechanism shown with the corner block in the extended position.

As shown in FIGS. 4 and 8-10, lower corner block 110 and stem 130 are located in an extended position with respect to base 70 and bottom surface 38 of container 22. As shown in FIG. 4, when lower corner block 110 is in the extended position, bottom surface 114 of lower corner block 110 is located a distance D below and outwardly from bottom surface 38 of base 32 of container 22, such as approximately one-half inch. As shown in FIGS. 8-10, when lower corner block 110 and stem 130 are in the extended position, axis 166 of cam 160 and axis 174 of camming member 170 are both located generally in the same plane with central axis 72 of base 70 or in a plane generally parallel to central axis 72, with axis 174 of camming member 170 located more closely adjacent to lower corner block 110 than axis 166 of cam 160. Central axis 212 of locking pins 208 and 210 is located generally perpendicular to central axis 72 of the base 70. As also shown in FIGS. 8-10, locking member 220 is in the locked position to thereby prevent rotation of cam 160 about axis 166 thereby locking lower corner block 110 and stem 130 in the extended position. As shown in FIG. 9, when locking member 220 is in the locked position, locking member 220 is generally aligned with central axis 72 of base 70 and is in alignment with first and second locking pins 208 and 210. As shown in FIG. 10, first locking pin 208 is adapted to engage distal end 234 of first locking arm 232 of locking member 220 to prevent counter-clockwise rotation of cam 160 about axis 166. Similarly, second locking pin 210 is adapted to engage distal end 238 of second locking arm 236 when locking member 220 is in the locked position to thereby prevent clockwise rotation of cam 160 about axis 166.

Figure 12:
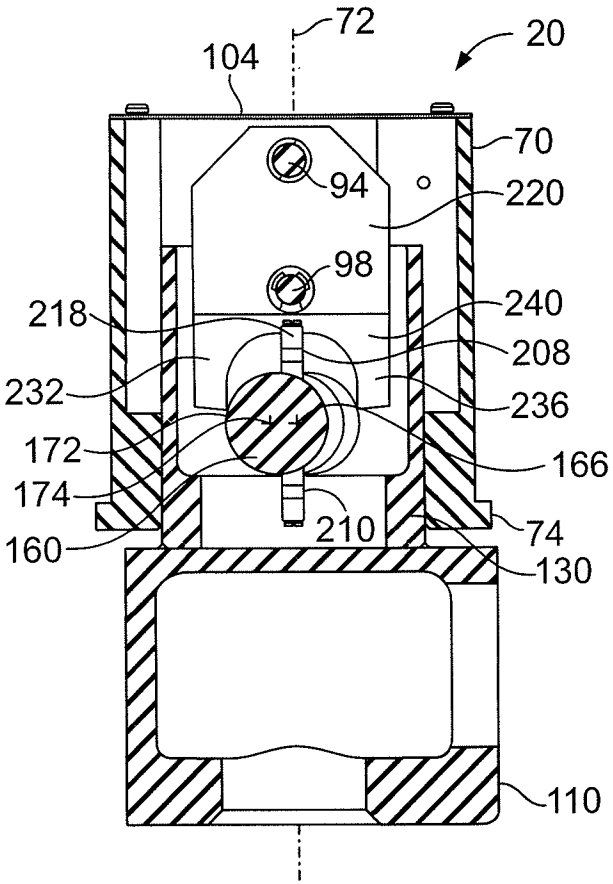
FIG. 12 is a cross sectional view taken along line 12-12 of FIG. 11.
Figure 11:
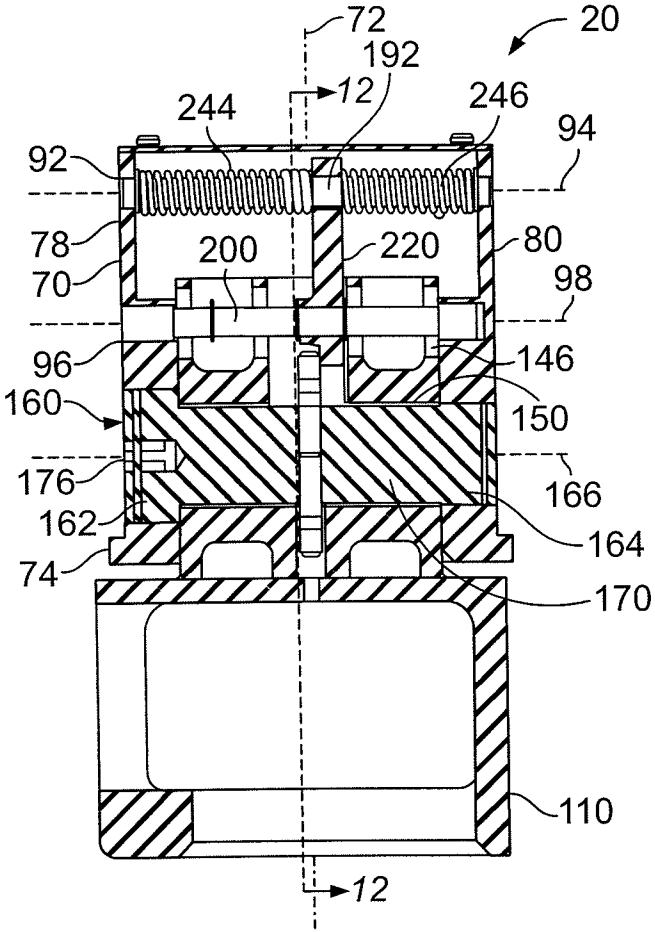
FIG. 11 is a cross sectional view of the corner block adjustment mechanism with the corner block in an intermediate position between the extended position and the retracted position of the corner block.
Figure 14:
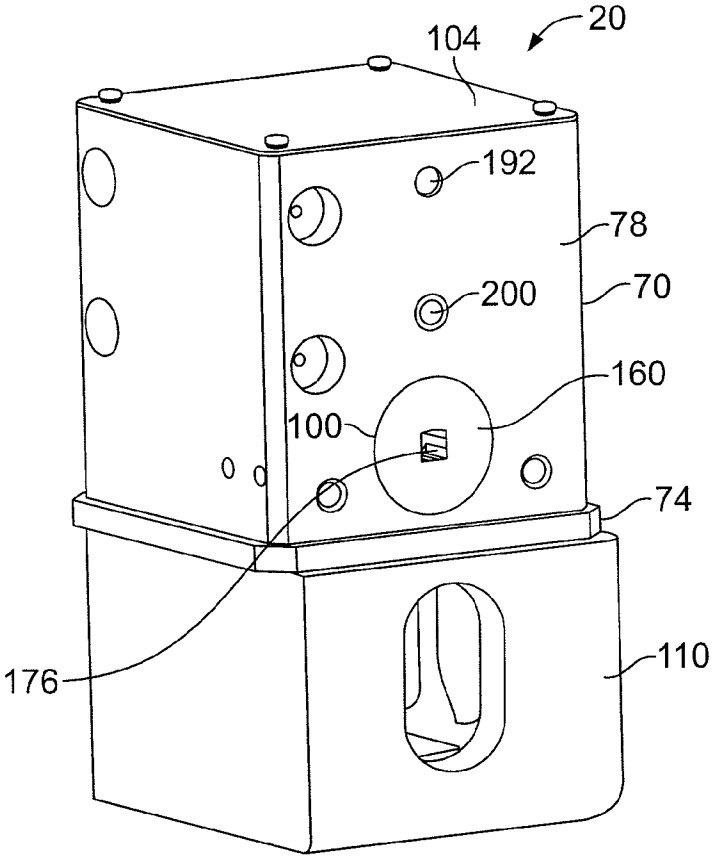
FIG. 14 is a perspective view of the corner block adjustment mechanism with the corner block shown in the retracted position.
Figure 13:
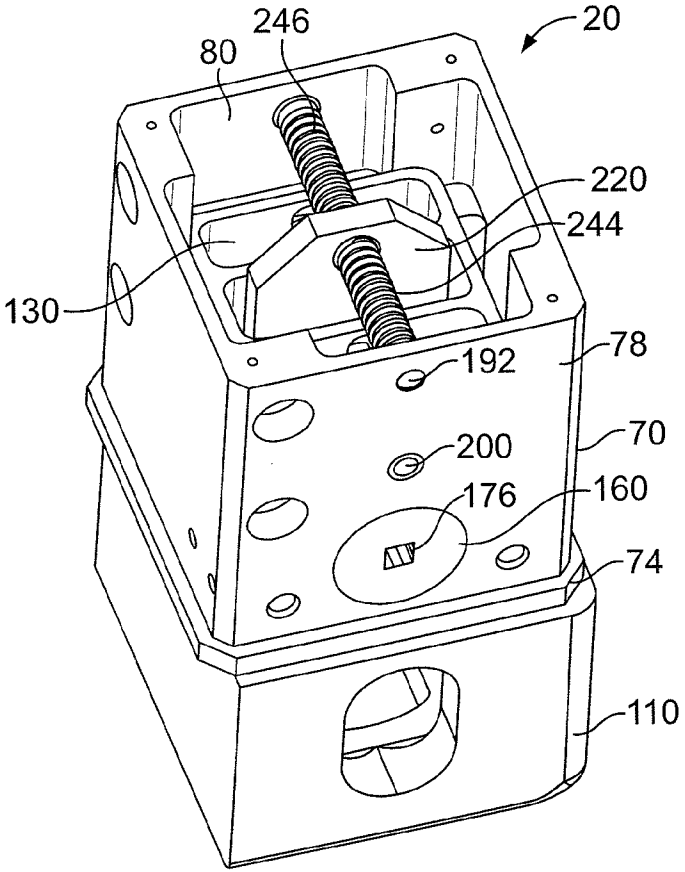
FIG. 13 is a perspective view of the corner block adjustment mechanism shown with the corner block in the retracted position and with the cover removed.
Figure 17:
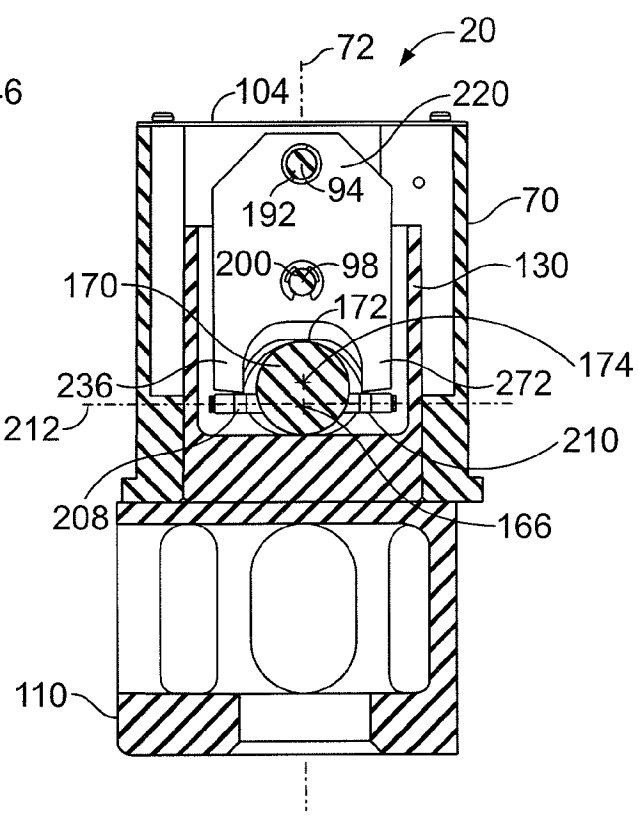
FIG. 17 is a cross sectional view taken along line 17-17 of FIG. 16.
Figure 16:
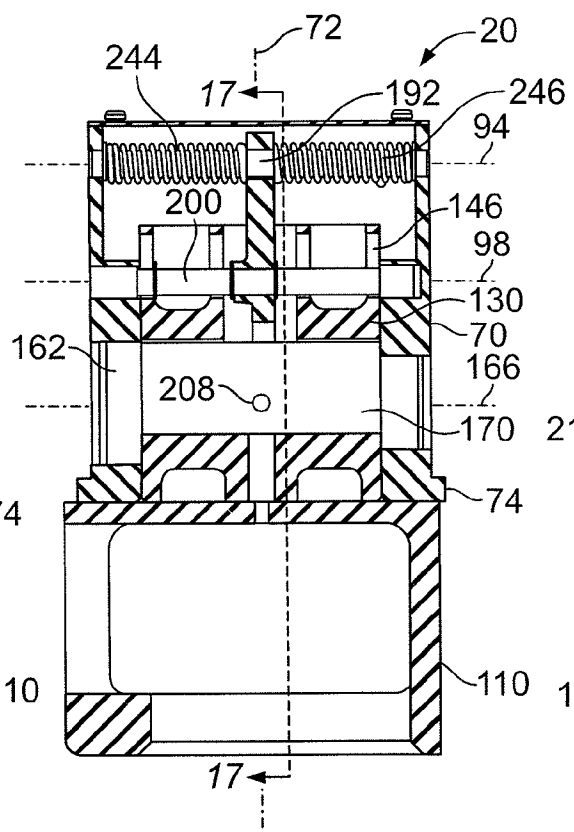
FIG. 16 is a cross sectional view taken along line 16-16 of FIG. 15.
Figure 15:
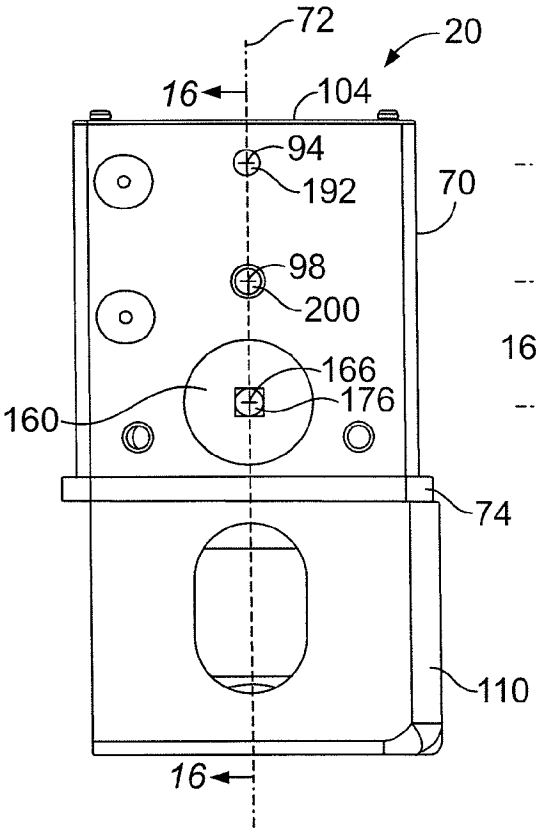
FIG. 15 is a side elevational view of the corner block adjustment mechanism shown with the corner block in the retracted position.
Figure 18:
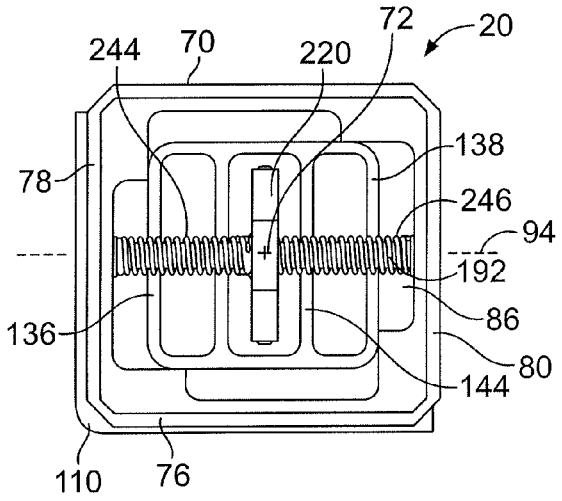
FIG. 18 is a top plan view of the corner block adjustment mechanism with the cover removed.
Figure 19:
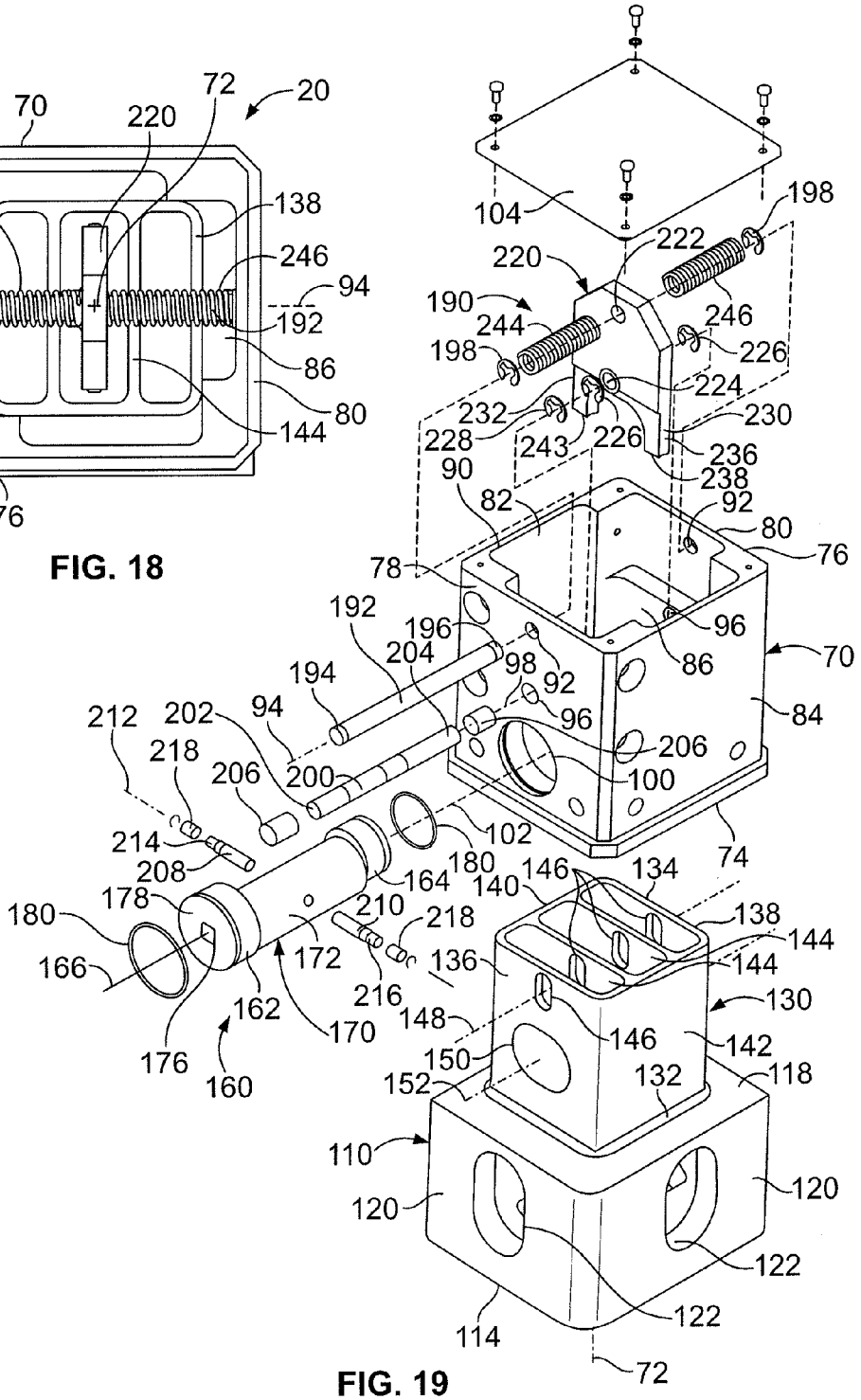
FIG. 19 is an exploded perspective view of the corner block adjustment mechanism.

When it is desired to move or slide lower corner block 110 and stem 130 from the extended position as shown in FIGS. 8-10 to the retracted position as shown in FIGS. 15-17, a tool or implement such as a screw driver is manually inserted through first aperture 52 in corner post 40 to engage and provide a biasing force against first end 202 of release pin 200. The tool slides release pin 200 and the attached locking member 220 along axis 98 toward second end wall 80 of base 70 and toward their unlocked position as shown in FIGS. 11 and 12. When release pin 200 and locking member 220 are in the unlocked position, locking member 220 is offset from central axis 72 of base 70 and is offset from the plane in which first locking pin 208 and second locking pin 210 rotate about axis 166.

While release pin 200 and locking member 220 are manually held in the unlocked position, a tool such as socket wrench, may be coupled to socket 176 of cam 160 to rotate cam 160 about axis 166 approximately one-half turn (180°) in either a clockwise or counter-clockwise direction. As cam 160 rotates about axis 166, one of the bushings 218 at distal ends 214 and 216 of first and second locking pins 208 and 210, depending upon the direction cam 160 is rotated about axis 166, rotatably engages the engagement surface 240 of locking member 220 such that the locking pin will retain the locking member 220 in the unlocked position and such that the biasing force provided by the tool may be removed from release pin 200. When cam 160 has been rotated one-half turn, the distal end of the locking pin that is in engagement with the engagement surface 240 will disengage from the engagement surface 240 when it reaches the distal end of the locking arm, whereupon the locking pin no longer retains the locking member 220 in the unlocked position. Biasing member 246 will then resiliently bias locking member 220 and release pin 200 from the unlocked position toward the locked position. Biasing member 246 and biasing member 244 resiliently bias locking member 220 and release pin 200 in opposite directions with respect to one another toward a neutral biasing force position wherein locking member 220 and release pin 200 are in the locked position.

Figure 5:
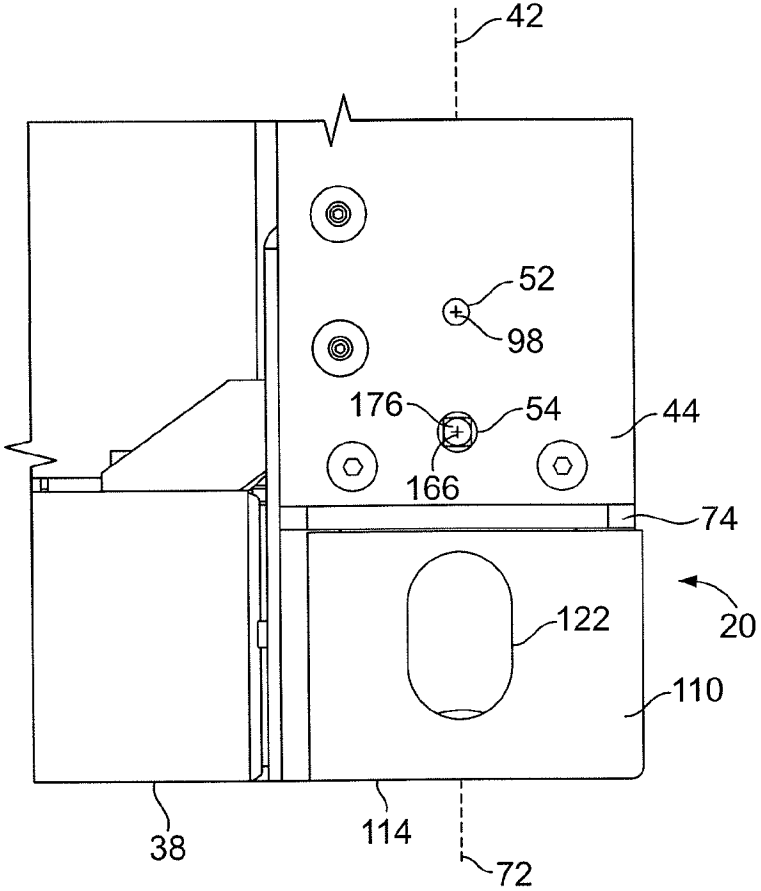
FIG. 5 is a side elevational view similar to that as shown in FIG. 4, but with the lower corner block shown in the retracted position.

As shown in FIG. 5 lower corner block 110 and stem 130 are in the retracted position with respect to base 70 of corner block adjust mechanism 20 and bottom surface 38 of base 32 of container 22, such that bottom surface 114 of lower corner block 110 is located generally coplanar with or inwardly from bottom surface 38 of base 32 of container 22. As shown in FIGS. 15-17, when lower corner block 110 and stem 130 are in the retracted position, axis 166 of cam 160 and axis 174 of camming member 170 are both located generally in the same plane with central axis 72 of base 70 or in a plane generally parallel to central axis 72, with axis 166 of cam 160 being located more closely adjacent to lower corner block 110 than axis 174 of camming member 170. Central axis 212 of first and second locking pins 208 and 210 is located generally perpendicular to central axis 72 of base 70. Locking member 220 is in the locked position such that locking pins 208 and 210 are adapted to engage distal ends 234 and 238 of first and second locking arms 232 and 236 to thereby prevent rotation of cam 160 about axis 166 and thereby lock lower corner block 110 and stem 130 in the retracted position. Lower corner block 110 and stem 130 can be selectively moved from the retracted position to the extended position in substantially the reverse manner as described in connection with movement from the extended position to the retracted position, including movement of the release pin 200 and locking member 220 from the locked position toward the unlocked position and then rotating cam 160 approximately one-half turn.

When lower corner block 110 is in the extended position with respect to base 70 and bottom surface 38 of container 22, such that bottom surface 114 of corner block 110 is located downwardly and outwardly from bottom surface 38 of container 22 as shown in FIG. 4, container 22 meets ISO container requirements and is suitable for shipment by truck, rail or ship. When lower corner block 110 is in the retracted position, such that bottom surface 114 of lower corner block 110 is substantially coplanar with or located inwardly from bottom surface 38 of container 22 as shown in FIG. 5, container 22 is adapted for loading internally within an aircraft for air transport because the lower corner block 110 does not project below the bottom surface 38 of container 22 and will not interfere with the cargo handling system of the aircraft.

Various features of the corner block adjustment mechanism have been particularly shown and described in connection with the illustrated embodiment, however, it must be understood that these particular arrangements merely illustrate, and that the corner block adjustment mechanism is to be given its fullest interpretation within the terms of the appended claims.

What is claimed is:

1. A corner block adjustment mechanism for use with a container, said corner block adjustment mechanism comprising:

a base adapted to be coupled to the container, said base including a central axis, a chamber, and a distal end having an opening in communication with said chamber;

a stem having a proximal end and a distal end, said stem extending through said opening in said base and into said chamber of said base;

a corner block coupled to said distal end of said stem; and a cam rotationally coupled to said base and to said stem, said cam being selectively rotatable about a first axis of said cam with respect to said base and said stem, said cam being selectively rotable between a first position wherein said corner block is located in an extended position with respect to said base and a second position wherein said corner block is located in a retracted position with respect to said base, said cam coupling said corner block to said base when said corner block is in said extended position and when said corner block is in said retracted position, said cam adapted to move said corner block from said extended position of said corner block toward said retracted position of said corner block generally parallel to said central axis of said base as said cam is moved from said first position of said cam toward said second position of said cam, said cam adapted to move said corner block from said retracted position of said corner block toward said extended position of said corner block generally parallel to said central axis of said base as said cam is moved from said second position of said cam toward said first position of said cam.

2. The corner block adjustment mechanism of claim 1 wherein said corner block includes a bottom surface, said bottom surface of said corner block adapted to be located outwardly from a bottom surface of the container when the corner block is in the extended position and adapted to be located generally coplanar with or inwardly from the bottom surface of the container when the corner block is in the retracted position.

3. The corner block adjustment mechanism of claim 2 wherein said corner block is an ISO corner block including a plurality of apertures.

4. The corner block adjustment mechanism of claim 1 wherein said cam includes a first hub rotationally coupled to said base, a second hub rotationally coupled to said base, and a camming member located between said first hub and said second hub.

5. The corner block adjustment mechanism of claim 4 wherein said camming member of said cam includes a first surface portion located a first distance from said first axis of said cam and a second surface portion located a second distance from said first axis of said cam, said first distance being longer than said second distance.

6. The corner block adjustment mechanism of claim 4 wherein said camming member is generally cylindrical, said camming member having a central axis that is generally parallel to and offset from said first axis of said cam, said camming member including a generally cylindrical camming surface.

7. The corner block adjustment mechanism of claim 4 including a first locking lug extending outwardly from said camming member and a second locking lug extending outwardly from said camming member, said first and second locking lugs extending from said camming member generally coaxially with respect to one another and generally transversely with respect to said first axis of said cam.

8. A corner block adjustment mechanism for use with a container, said corner block adjustment mechanism comprising:

a base adapted to be coupled to the container, said base including a central axis, a chamber and a distal end having an opening in communication with said chamber;

a stem having a proximal end and a distal end, said stem extending through said opening in said base and into said chamber of said base;

a corner block coupled to said distal end of said stem, said stem and said corner block being slidable along said central axis of said base with respect to said base between an extended position and a retracted position of said corner block;

a cam rotationally coupled to said base for selective rotation about a first axis of said cam, said cam including a camming member rotationally coupled to said stem, said cam including a first locking lug extending outwardly from said camming member and a second locking lug extending outwardly from said camming member, said cam being selectively rotatable between a first position wherein said corner block is in said extended position and a second position wherein said corner block is in said retracted position; and a locking mechanism including a locking member slidably coupled to said base by a guide member, said locking member being selectively slidable along said guide member between a locked position and an unlocked position, a release member coupled to said locking member, said release member adapted to selectively move said locking member from said locked position toward said unlocked position, and a biasing member adapted to resiliently bias said locking member toward said locked position;

whereby when said locking member is in said locked position and said cam is in said first position said locking member is adapted to engage said locking lugs of said cam and prevent rotation of said cam thereby locking said corner block in said extended position, and whereby when said locking member is in the locked position and said cam is in said second position said locking member is adapted to engage said locking lugs of said cam and prevent rotation of said cam thereby locking said corner block in said extended position, said locking member allowing selective rotation of said cam between said first position and said second position of said cam when said locking member is in said unlocked position.

9. A corner block adjustment mechanism for use with a container, said corner block adjustment mechanism comprising:

a base adapted to be coupled to the container, said base including a central axis, a chamber, and a distal end having an opening in communication with said chamber;

a stem having a proximal end and a distal end, said stem extending through said opening in said base and into said chamber of said base;

a corner block coupled to said distal end of said stem;

a cam rotationally coupled to said base and to said stem, said cam being selectively rotable about a first axis of said cam with respect to said base and said stem, said cam being selectively rotable between a first position wherein said corner block is located in an extended position with respect to said base and a second position wherein said corner block is located in a retracted position with respect to said base, said cam adapted to move said corner block generally parallel to said central axis of said base between said extended position and said retracted position of said corner block as said cam is moved between said first position and said second position of said cam;

a locking mechanism adapted to releasably lock said cam in said first position and to releasably lock said cam in said second position, said locking mechanism including a locking member adapted to releasably engage said cam, said locking member being selectively movable between a locked position wherein said locking mechanism is adapted to prevent rotation of said cam about said first axis and an unlocked position wherein said locking member allows rotation of said cam about said first axis; and a release member slidably coupled to said base and coupled to said locking member, said release member being selectively movable from a locked position toward an unlocked position, said release member conjointly movable with said locking member from said locked position of said locking member toward said unlocked position of said locking member as said release member is moved from said locked position of said release member toward said unlocked position of said release member.

10. The corner block adjustment mechanism of claim 9 including a guide member coupled to said base, said locking member being slidably coupled to said guide member, whereby said locking member is slidable along said guide member as said locking member moves between said locked position of said locking member and said unlocked position of said locking member.

11. The corner block adjustment mechanism of claim 10 including a first biasing member adapted to resiliently bias said locking member from said unlocked position of said locking member toward said locked position of said locking member.

12. The corner block adjustment mechanism of claim 11 including a second biasing member adapted to resiliently bias said locking member from said locked position of said locking member toward said unlocked position of said locking member, said first and second biasing members extending along said guide member and located on opposite sides of said locking member.

13. The corner block adjustment mechanism of claim 10 wherein said release member comprises a release pin having a second axis, and said guide member comprises a guide pin having a third axis, said first axis, said second axis and said third axis being generally parallel to one another and generally transverse to said central axis of said base.

14. The corner block of claim 13 wherein said stem includes one or more first slots adapted to receive said cam, and one or more second slots adapted to receive said release member.

15. A corner block adjustment mechanism for use with a container, said corner block adjustment mechanism comprising:

a base adapted to be coupled to the container, said base including a central axis, a chamber, and a distal end having an opening in communication with said chamber;

a stem having a proximal end and a distal end, said stem extending through said opening in said base and into said chamber of said base;

a corner block coupled to said distal end of said stem;

a cam rotationally coupled to said base and to said stem, said cam being selectively rotable about a first axis of said cam with respect to said base and said stem, said cam being selectively rotable between a first position wherein said corner block is located in an extended position with respect to said base and a second position wherein said corner block is located in a retracted position with respect to said base, said cam adapted to move said corner block generally parallel to said central axis of said base between said extended position and said retracted position of said corner block as said cam is moved between said first position and said second position of said cam;

a locking mechanism adapted to releasably lock said cam in said first position and to releasably lock said cam in said second position, said locking mechanism including a locking member adapted to releasably engage said cam, said locking member being selectively movable between a locked position wherein said locking mechanism is adapted to prevent rotation of said cam about said first axis and an unlocked position wherein said locking member allows rotation of said cam about said first axis, said locking member including a first arm having a first end and a second arm having a second end, said first arm being spaced apart from said second arm, said camming member being located between said first arm and said second arm, said first end of said first arm adapted to engage said cam and prevent rotation of said cam in a first rotational direction about said first axis when said locking member is in said locked position, and said second end of said second arm adapted to engage said cam and prevent rotation of said cam in a second rotational direction about said first axis when said locking member is in said locked position.

16. The corner block adjustment mechanism of claim 15 wherein said cam includes an outwardly extending first locking lug and an outwardly extending second locking lug, said first arm of said locking member adapted to engage said first locking lug when said locking member is in said locked position and said second arm of said locking member adapted to engage said second locking lug when said locking member is in said locked position.

17. The corner block adjustment mechanism of claim 16 wherein said first locking lug includes a rotatable first roller and said second locking lug includes a rotatable second roller, said first roller adapted to roll along an engagement surface of said first arm and said second arm of said locking member when said locking member is in said unlocked position and said cam member is rotated in a first rotational direction from said first position toward said second position, said second roller adapted to roll along an engagement surface of said second arm and said first arm of said locking member when said locking member is in said unlocked position and said cam is rotated in a second rotational direction from said first position toward said second position.

18. A corner block adjustment mechanism for use with a container having a corner post and a bottom surface, said corner block adjustment mechanism comprising:

a base adapted to be coupled to the corner post of the container, said base including a central axis, a chamber, and a distal end having an opening in communication with said chamber;

a stem having a proximal end and a distal end, said stem extending through said opening in said base and into said chamber of said base;

a corner block coupled to said distal end of said stem, said corner block having a bottom surface;

a cam rotationally coupled to said base and to said stem, said cam being selectively rotable about a first axis of said cam with respect to said base and said stem, said cam being selectively rotable between a first position wherein said corner block is located in an extended position with respect to said base and to the bottom surface of the container and a second position wherein said corner block is located in a retracted position with respect to said base and to the bottom surface of the container, said cam adapted to move said corner block generally parallel to said central axis of said base between said extended position and said retracted position of said corner block as said cam is moved between said first position and said second position of said cam, said bottom surface of said corner block adapted to be located outwardly from the bottom surface of the container when said corner block is in the extended position and said bottom surface of said corner block adapted to be located generally coplanar with or inwardly from the bottom surface of the container when said corner block is in the retracted position.

* * * * *